United States Patent [19]

Elsfelder

[11] Patent Number: 4,685,568

[45] Date of Patent: Aug. 11, 1987

[54] DISPLAY TRAY WITH REVERSIBLE INSERTS

[76] Inventor: Leonard Elsfelder, 8108 Old State Rd., Evansville, Ind. 47710

[21] Appl. No.: 898,648

[22] Filed: Aug. 21, 1986

[51] Int. Cl.[4] ..... B65D 1/34; B65D 6/04

[52] U.S. Cl. ..... 206/561; 206/44.12; 206/564; 206/566; 53/396

[58] Field of Search ..... 206/566, 45.19, 45.11, 206/45.12, 44.12, 557–565, 567, 45.14, 44 R; 53/396

[56] References Cited

U.S. PATENT DOCUMENTS

| | | | |
|---|---|---|---|
| 862,729 | 8/1907 | Goldsmith . | |
| 1,045,675 | 11/1912 | Cardy . | |
| 1,061,374 | 5/1913 | Harrington . | |
| 1,096,616 | 5/1914 | Feuerstein | 206/459 |
| 1,278,354 | 9/1918 | Kendis . | |
| 1,284,322 | 11/1918 | Hammond . | |
| 1,289,193 | 12/1918 | Kline | 206/566 X |
| 1,456,613 | 5/1923 | Bartels . | |
| 1,527,719 | 2/1925 | Wetherell | 206/562 X |
| 1,581,271 | 4/1926 | Korfist . | |
| 1,823,324 | 9/1931 | Huber . | |
| 2,788,123 | 4/1957 | Levis et al. . | |
| 3,209,903 | 10/1965 | Shiffman | 206/562 X |
| 3,866,748 | 2/1975 | Manning, Jr. . | |
| 3,880,342 | 4/1975 | Longo, Jr. . | |
| 4,350,249 | 9/1982 | Caston | 206/566 |
| 4,388,959 | 6/1983 | Handy et al. . | |
| 4,420,084 | 12/1983 | Whelan . | |
| 4,432,456 | 2/1984 | Ovadia et al. | 206/566 |

*Primary Examiner*—William Price

*Attorney, Agent, or Firm*—Barnes & Thornburg

[57] ABSTRACT

A display tray has a tray bed in which removable and reversible inserts are placed. A first side of each insert is adapted to hold an article for display and a second side is blank, has a label thereon or has some decorative appearance. To display an article, it is affixed to the side of the insert adapted to hold it. The insert is placed in the tray bed with the first side showing. When the article is removed from the insert, the insert is removed from the tray bed, reversed and placed back in the tray bed with its second side showing thus presenting a more pleasing appearance. The tray bed can be filled with inserts which are shaped such that they cooperate to substantially fill the tray bed.

10 Claims, 4 Drawing Figures

10
12
14
16
18
20
22
24
26
28
30
34
2

10
12
13
14
16
18
20
22
24
26
28
30
32
34

10
12
16
18
20
22
24
28
34
Store
Name 10
18
20
24
28
34

DISPLAY TRAY WITH REVERSIBLE INSERTS

This invention relates to devices for displaying items. More particularly, this invention relates to a display tray or frame having removable and reversible display elements.

Items such as rings, earrings, and photographs are displayed and stored in a variety of trays, frames or holders. For example, a typical jewelry display device includes a multi-slotted surface for displaying rings or jewelry items. As rings are displaced, the slots are left empty and the overall appearance of the display surface becomes much less attractive. Nor does such a method provide a convenient or inconspicuous method of identifying and/or labeling each item as to style or price.

Another common type of display device is an individual box having a cushioned insert and an attached cover or lid. Individual display boxes are placed next to each other with their respective lids open. The problem with such display devices, however, is that the opened lid completely blocks light from one direction. Thus the particular item, such as jewelry, cannot be shown under optimum lighting conditions. Moreover, as an item is sold and the box is removed, a void is left in the array of display boxes or another boxed item must be inserted in its place.

Another significant problem presented by many current jewelry display methods and devices involves theft. If an item is stolen or removed from one of several slots, or if a separate jewelry box is removed, it is not readily apparent whether an item has been stolen or has actually been sold.

It is, therefore, an object of the present invention to provide a display apparatus having a pleasing appearance.

Another object of the present invention is to provide a display tray having individual inserts on which items are held for display and which are easily removable and reversible within the device.

A still further object of the present invention is to provide reversible inserts which can be easily removed from the display tray when an item is displaced from the display insert and reversed to present a decorative surface, thereby effecting and maintaining a pleasing and attractive appearance for the display tray.

Another object is to provide a display device and method for displaying items providing an effective means for security and inventory control.

Another object of the present invention is to provide a display device and method for displaying items under optimum lighting conditions.

Still another object is to provide a handsome display tray in which the individual display inserts substantially fill the tray bed but may be easily removed and reversed as desired.

The foregoing features and advantages are generally accomplished by providing a display apparatus in the form of a tray bed and a plurality of removable and reversible display inserts. Each of the inserts includes a first side having means for holding items for display and a second side. The second side is blank or has a label or decorative feature affixed thereon. The first side of the insert is presented for viewing when an article is held in the holding means. When an article has been displaced from the holding means, the insert is removed from the tray bed, reversed, and replaced in the display bed. The second side is then presented for viewing. The inserts are so shaped as to be compatible with all other inserts and to allow several inserts to be placed alongside one another such that the tray bed is substantially filled. The tray bed may have at least one opening to aid in the removal of the inserts from the tray bed. Removal of the inserts can thus be easily accomplished by pushing upwards on the bottom surface of one or more inserts through such an opening in the tray bed.

Additional features and advantages of the present invention will become apparent to those skilled in the art from the following detailed description of a preferred, but nonetheless illustrative, embodiment exemplifying the best mode of carrying out the invention as presently perceived. The detailed description particularly refers to the accompanying figures in which.

Figure 1:
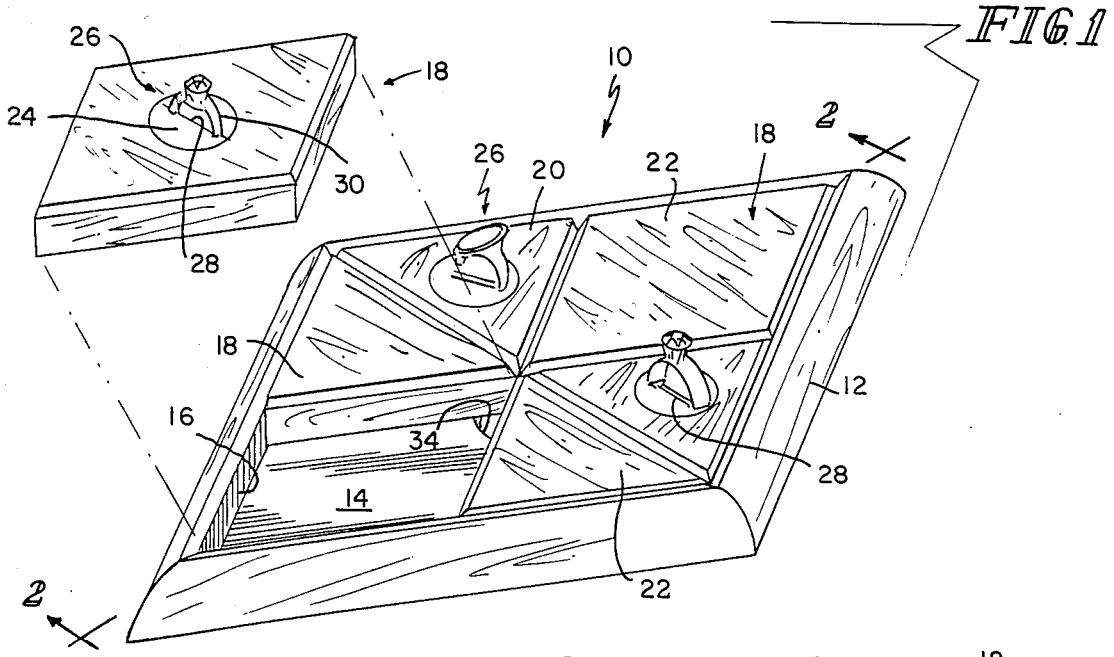
FIG. 1 is an exploded assembly view of a first embodiment of a display tray incorporating the principles of the invention.

Referring to FIG. 1, a display tray 10 has a tray bed or frame 12. Illustratively, tray bed 12 is constructed of a rigid material such as wood or plastic. Tray bed 12 has a flat bottom surface 14 surrounded by an upwardly extending peripheral edge 16. Peripheral edge 16 provides a simple yet effective retention system for inserts 18.

Each insert 18 includes a first side 20 and a second side 22. The first side 20 includes means 24 for holding an article 26 for display. Inserts 18 are geometrically shaped as to be compatible with one another and to fit alongside each other within the tray bed 12.

Figure 2:
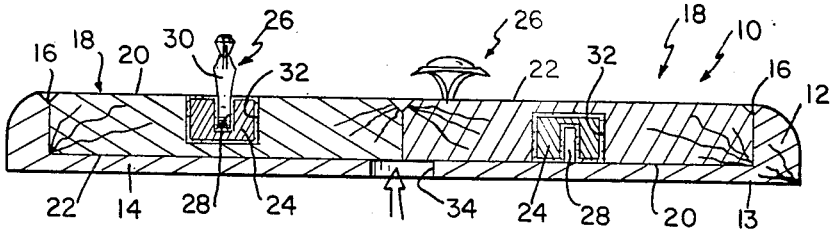
FIG. 2 is a sectional of the display tray of FIG. 1 taken along line 2-2 and containing an insert having a ring displayed thereon and a second insert having its reverse or second side presented for viewing.

As shown in FIGS. 1 and 2, a ring 26 is held by holding means 24. Holding means 24 has a slot 28. A ring band 30 of ring 26 is placed in slot 28 to hold ring 26 in place. The first side 20 of each insert 18 can include a recess 32 to receive the holding means 24, as best shown in FIG. 2.

Figure 4:
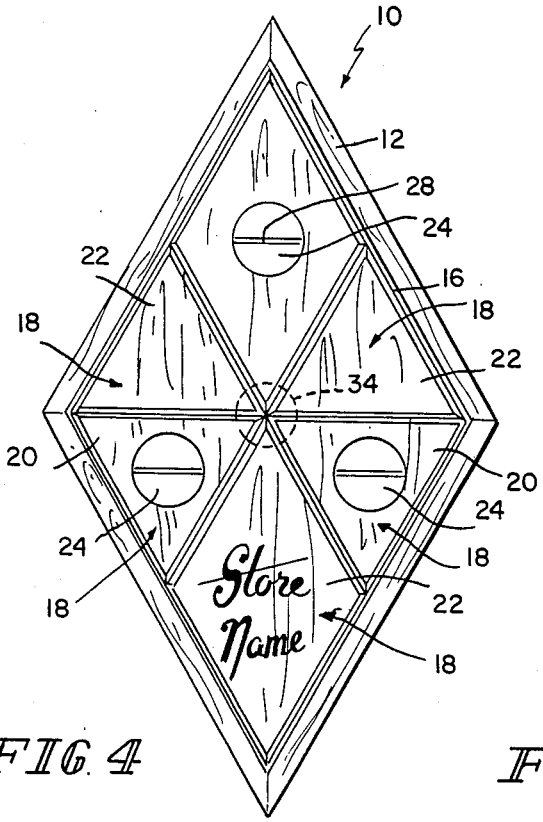
FIG. 4 is a top view of a display tray after certain inserts have been removed from the tray and reversed so that their second or non-article holding side is presented for viewing.

Referring to FIG. 2, when an item such as ring 26, is displaced from the holding means 24 of one of the inserts 18, the insert 18 is removed from the tray bed 12, reversed, and reinserted into the tray bed 12 such that the second side 22 of the insert 18 is now facing upward. Second side 22 of the insert 18 is thus presented for viewing. This reverse configuration is also illustrated in FIG. 4. In FIG. 4, inserts 18 are shown with either their first or second sides presented for viewing.

Figure 3:
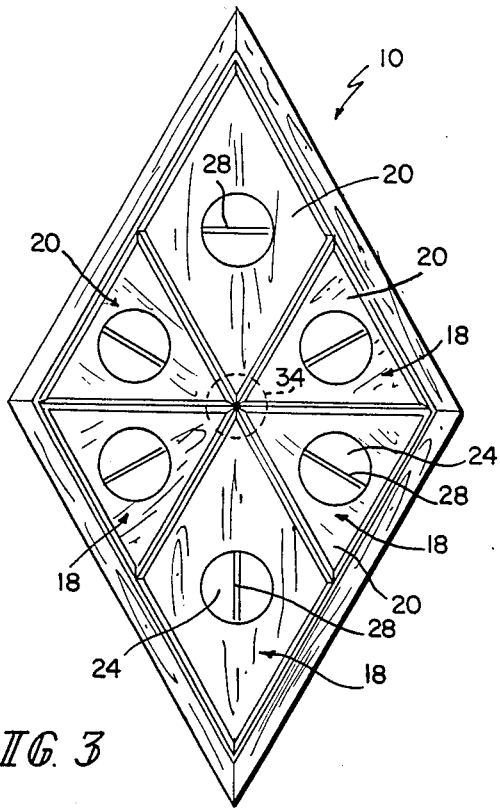
FIG. 3 is a top view of a display tray having the first or article-holding sides of all display inserts presented for viewing.

Referring to FIG. 2, the tray bed 12 may have one or more openings 34 in its bottom surface 14 to aid in the removal of inserts 18 from the tray bed 12. By the use of such an opening 34 is in the tray bed 12, the inserts 18 may be easily pushed up and out of the display tray 10. For example, as shown in FIGS. 3 and 4, the opening 34 is placed at the focal point where all of the edges of the inserts 18 converge. By pushing up through the opening 34, all of the inserts 18 can be removed.

The product and method of this invention are further described with reference to FIGS. 3 and 4. As shown in FIG. 3, a plurality of inserts 18 are inserted into the tray bed 12, with the first side 20 of each insert facing up. The first side 20 of each insert 18 is thus presented for viewing. The inserts 18 are shaped such that when a predetermined number of inserts 18 are placed in the tray bed 12 adjacent each other, the geometric shape formed by the combination of inserts 18, conforms to the geometric shape of the tray bed 12 and the inserts 18 substantially fill the tray bed.

FIG. 4 illustrates the same tray bed 12 having certain inserts 18 with their reverse or second sides 22 facing up and presented for viewing.

As shown in the figures, the inserts 18 may be triangular in shape, shaped as parallelograms, or of any other appropriate geometric shape such that when a predetermined number of inserts is placed in the tray bed 12 adjacent each other, the inserts 18 combine to form a geometric shape which conforms to the geometric shape of the tray bed 12 and substantially fill the tray bed 12. When the inserts 18 are inserted in the tray bed 12 in such configurations, the inserts 18 provide an attractive display appearance.

Suitable materials for the inserts 18 are any materials or material having sufficient rigidity. Typical examples of such materials are wood, metal, plastic, glass, or other similar rigid materials as well as combinations thereof. Any materials used for both the tray bed 12 and the inserts 18 may have any appropriate decorative or utilitarian color, transparency, or mixtures thereof. It is to be appreciated, of course, that numerous shapes, dimensions, and configurations can be used for both the tray bed 12 and inserts 18.

As presented herein, the display tray 10 of the present invention provides an efficient and attractive means and method for displaying articles, such as ring 26. Individual removable and reversible display inserts 18 cooperate with each other and the peripheral edge 16 of tray bed 18 to provide an original and attractive display system. Such a combination provides for the maintenance of an attractive and pleasing display appearance as articles are displaced from the inserts 18. Such display method and device also provides a simple, yet effective, means for securing inventory from theft.

Display tray 10 further provides a convenient and inconspicuous means for identifying and/or labeling each item that is on display. For example, the second side 22 of each insert 18 can be appropriately labeled to identify each item as well as its cost, etc. When an item is sold, the insert 18 can be reversed to present its second side 22, and the label can be removed.

While this invention has been described with particular reference to a display tray for jewelry items, it is to be understood that the invention described herein can be used to display many various articles, including photographs, art work, crafts, etc. Such adaptations, modifications, and changes are intended to be embraced within the scope and spirit of the invention as described and defined in the following claims.

What is claimed is:

1. A display tray comprising a tray bed and a plurality of inserts, each insert having a first side which includes means for holding an article and a second side, the inserts removably received in the tray bed with the first side presented for viewing when an article is held in the holding means, and the inserts removably received in the tray bed with the second side presented for viewing when an article is not held by the holding means.

2. The display tray of claim 1 wherein the first side of said inserts includes at least one recess for receiving said holding means.

3. The display tray of claim 1 wherein said tray bed has at least one opening to aid in the removal of said inserts.

4. The display tray of claim 1 wherein said tray bed has the shape of a parallelogram.

5. The display tray of claim 1 wherein said inserts are shaped as parallelograms.

6. The display tray of claim 1 wherein said inserts are triangular in shape.

7. The display tray of claim 3 wherein said opening is located at a focal point where all of said inserts come together and meet, to permit all of said inserts to be simultaneously pushed up and removed from the tray bed.

8. A display tray comprising a tray bed and a plurality of inserts, each insert having a first side which includes means for holding an article and a second side, the inserts removably received in the tray bed with the first side presented for viewing when an article is held in the holding means, and the inserts removably received in the tray bed with the second side presented for viewing when an article is not held by the holding means, the inserts being so shaped as to be compatible with each other and with the tray bed such that when a predetermined number of inserts are removably received in the tray bed, the tray bed is substantially filled.

9. A method for displaying articles, comprising the steps of removably affixing each article to be displayed to a first side of an article holding insert, each insert having a second side, placing each insert to which an article is affixed in a tray bed with its first side facing outwardly, and when an article is removed from one of the inserts in the tray bed, turning the insert from which the article was removed so that the insert's second side faces outwardly.

10. The method of claim 9 wherein the inserts are shaped to form a geometric shape when a predetermined number of inserts are placed adjacent each other, the tray bed having the same geometric shape as the geometric shape formed by placing the predetermined number of inserts adjacent each other, and the method for displaying articles includes the step of placing the predetermined number of inserts in the display tray adjacent each other such that the geometric shape formed by the predetermined number of inserts conforms to the tray bed's geometric shape and the inserts substantially fill the tray bed.

* * * * *